US007874503B2

(12) United States Patent
Imahori et al.

(10) Patent No.: US 7,874,503 B2
(45) **Date of Patent: *Jan. 25, 2011**

(54) ELECTROSTATCIALLY ATOMIZING DEVICE

(75) Inventors: Osamu Imahori, Hikone (JP); Toshihisa Hirai, Hikone (JP); Kishiko Hirai, legal representative, Hikone (JP); Akihide Sugawa, Hikone (JP); Fumio Mihara, Hikone (JP); Shousuke Akisada, Hikone (JP); Tomoharu Watanabe, Osaka (JP); Hirokazu Yoshioka, Osaka (JP); Kentaro Kobayashi, Nishinomiya (JP); Shinya Murase, Hikone (JP); Kouichi Hirai, Hikone (JP); Junji Imai, Amagasaki (JP)

(73) Assignee: Panasonic Electric Works Co., Ltd., Kadoma-shi (JP)

( * ) Notice: Subject to any disclaimer, the term of this patent is extended or adjusted under 35 U.S.C. 154(b) by 769 days.

This patent is subject to a terminal disclaimer.

(21) Appl. No.: 11/547,132

(22) PCT Filed: Apr. 1, 2005

(86) PCT No.: PCT/JP2005/006496
§ 371 (c)(1),
(2), (4) Date: Oct. 4, 2006

(87) PCT Pub. No.: WO2005/097338
PCT Pub. Date: Oct. 20, 2005

(65) Prior Publication Data

US 2009/0001200 A1 Jan. 1, 2009

(30) Foreign Application Priority Data

| | | |
|---|---|---|
| Apr. 8, 2004 | (JP) | 2004-114364 |
| Jun. 21, 2004 | (JP) | 2004-182920 |
| Jan. 26, 2005 | (JP) | 2005-018682 |

(51) Int. Cl.
*B05B 5/00* (2006.01)
*B05B 5/053* (2006.01)
*F23D 11/32* (2006.01)

(52) U.S. Cl. ..... 239/695; 239/128; 239/690.1; 361/228; 361/226; 361/225; 62/129; 62/135

(58) Field of Classification Search ..... 239/690, 239/695, 708, 128, 423, 433, 397.5; 261/107, 261/78.2, 140.1, DIG. 16.65; 361/228; 700/299; 62/93, 272
See application file for complete search history.

(56) References Cited

U.S. PATENT DOCUMENTS 5,337,963 A 8/1994 Noakes (Continued)

FOREIGN PATENT DOCUMENTS

EP 0 486 198 A1 5/1992

(Continued)

OTHER PUBLICATIONS

The Japanese Patent Office Action for corresponding Japanese patent application No. 2004-182920, dated Feb. 13, 2007. (Citing References AF-AI).

(Continued)

*Primary Examiner*—Len Tran
*Assistant Examiner*—Justin Jonaitis
(74) *Attorney, Agent, or Firm*—Edwards Angell Palmer & Dodge LLP

(57) ABSTRACT

An electrostatically atomizing device capable of instantly giving an electrostatically atomizing effect without requiring a water tank. The electrostatically atomizing device includes an emitter electrode, an opposed electrode opposed to the emitter electrode, a water feeder configured to give water on the emitter electrode, and a high voltage source configured to apply a high voltage across said emitter electrode and said opposed electrode to electrostatically charge the water on the emitter electrode for spraying charged minute water particles from a discharge end of the emitter electrode. The water feeder is configured to condense the water on the emitter electrode from within the surrounding air, enabling to supply the water on the emitter electrode in a short time without relying upon an additional water tank. Thus, an atomization of the charged minute water particles can be obtained immediately upon use of the device.

14 Claims, 5 Drawing Sheets

U.S. PATENT DOCUMENTS

| | | | | |
|---|---|---|---|---|
| 5,865,031 | A * | 2/1999 | Itakura | 62/3.7 |
| 6,866,212 | B2 * | 3/2005 | Sumiyoshi et al. | 239/690 |
| 7,473,298 | B2 * | 1/2009 | Suda et al. | 95/64 |
| 7,567,420 | B2 * | 7/2009 | Kobayashi et al. | 361/228 |
| 2006/0131449 | A1 * | 6/2006 | Azukizawa et al. | 239/690.1 |
| 2007/0063077 | A1 * | 3/2007 | Keudell et al. | 239/690 |
| 2007/0119993 | A1 * | 5/2007 | Yamaguchi et al. | 239/704 |
| 2008/0029211 | A1 * | 2/2008 | Sun et al. | 156/272.6 |

FOREIGN PATENT DOCUMENTS

| | | |
|---|---|---|
| JP | 62-144774 | 6/1987 |
| JP | 04-205872 | 7/1992 |
| JP | 5-345156 | 12/1993 |
| JP | 11-009671 | 1/1999 |
| JP | 11-56994 | 3/1999 |
| JP | 2001-286546 | 10/2001 |
| JP | 3260150 | 2/2002 |
| JP | 2002-203657 | 7/2002 |
| JP | 2002-263026A A | 9/2002 |
| JP | 2003-14261 | 1/2003 |
| JP | 2003-079714 | 3/2003 |
| JP | 2003-79714 | 3/2003 |
| JP | 2003-287316 | 10/2003 |
| JP | 2004-358362 | 12/2004 |
| JP | 4016934 | 5/2005 |

OTHER PUBLICATIONS

Notification of Reason(s) for Refusal mailed Dec. 2, 2008, issued on Japanese Patent Application No. 2004-114364 and the English translation thereof.

* cited by examiner

ELECTROSTATCIALLY ATOMIZING DEVICE

BACKGROUND OF THE INVENTION

1. Field of the Invention

The present invention relates to an electrostatically atomizing device, and more particularly to the electrostatically atomizing device which condenses water contained in the air and electrostatically charges the condensed water so as to spray the minute water particles of a nanometer order.

2. Description of the Related Art

Japanese patent publication No. 5-345156 A discloses a prior art electrostatically atomizing device generating charged minute water particles of a nanometer order (nanometer sized mist). The device is configured to apply a high voltage across an emitter electrode supplied with the water and an opposed electrode to induce Rayleigh disintegration of the water carried on the emitter electrode, thereby atomizing the water. The charged minute water particles thus obtained contain radicals and remain over a long period of time to be diffused into a space in a large amount, thereby being allowed to react effectively with offensive odors adhered to a room wall, clothing, or curtains to deodorize the same.

However, because the above device relies upon a water tank containing the water which is supplied through a capillary effect to the emitter electrode, it forces the user to replenish the tank. In order to eliminate the inconvenience, it may be possible to use a heat exchanger which condenses the water by cooling the surrounding air and supplying the water condensed at the heat exchanger to the emitter electrode. However, this scheme will take at least several minutes to obtain the water (condensed water) generated at the heat exchanger and supply the condensed water to the emitter electrode, and therefore poses a problem of being not applicable to an appliance such as a hair dryer which is operated only for a short time.

SUMMARY OF THE INVENTION

In view of the above problem, the present invention has been accomplished to give a solution of providing an electrostatically atomizing device which is capable of eliminating the water tank and instantly giving an electrostatically atomizing effect.

The electrostatically atomizing device in accordance with the present invention includes an emitter electrode, an opposed electrode opposed to the emitter electrode, a water feeder configured to give water on the emitter electrode, and a high voltage source configured to apply a high voltage across said emitter electrode and said opposed electrode to electrostatically charge the water on the emitter electrode for spraying charged minute water particles from a discharge end of the emitter electrode. The water feeder is configured to condense the water on the emitter electrode from within the surrounding air. Thus, the water contained in the air can be condensed on the emitter electrode, which enables the water to be supplied to the emitter electrode within a short time period yet without the use of an additional water tank. Accordingly, the atomization of the charged minute water particles can be obtained instantly upon use of the device.

Preferably, the water feeder comprises a refrigerator which cools the emitter electrode to allow the water to condense on the emitter electrode from within the surrounding air.

The water feeder may be configured to have a freezing function of freezing water content of the surrounding air on the emitter electrode, and also have a melting function of melting the frozen water on the emitter electrode.

Further, the device of the present invention preferably includes a fan which is configured to introduce the surrounding air around the emitter electrode through an air intake path. With this arrangement, it is possible to supply the humid air constantly around the emitter electrode to keep a predetermined amount of the condensed water. Also, the resulting air flow is utilized to carry the mist of the charged minute water particles emitted from the emitter electrode and discharge the particles outwardly.

The refrigerator is combined with a heat radiator to define a heat exchanger which is accommodated within a housing together with the emitter electrode. In this instance, the housing may be formed with a heat exchange path which is separated from the air intake path to introduce the surrounding air to the heat radiator and to drive it out of the housing. Thus, the air introduced from the outside and heated by the heat radiator is kept free from leaking to the side of the emitter electrode and, therefore, from raising the temperature around the emitter electrode, avoiding the lowering of the water condensation efficiency at the emitter electrode.

Further, the emitter electrode is preferably formed with a water container which holds a volume of water so that it can store the water upon seeing an excessive condensation and to secure an atomizing amount of the water by use of the water in the container in a condition where the water is difficult to be generated. Also, it is possible to reduce a hazard that the excessive water invades into other portions to cause a short-circuit.

The refrigerator may be realized by a Peltier-effect thermoelectric module which is compact yet has high cooling efficiency.

Further, the present invention discloses the device provided with a plurality of the emitter electrodes. In this instance, the plural emitter electrodes are thermally coupled to the refrigerator to have the respective discharge ends cooled to the same temperature, and at the same time electrically coupled to the high voltage source to have the respective discharge ends receiving the same electric field strength. Thus, it is possible to give a large amount of the mist of the charged minute water particles with the use of a single refrigerator.

The plural emitter electrodes are preferred to be integrated into a single electrode assembly. The electrode assembly has a single stem coupled to the refrigerator, and the emitter electrodes extend from the single stem, respectively, by way of branches. The use of the electrode assembly integrating the plural emitter electrodes leads to easy fabrication. Also, it is possible to give the same cooling temperature to the discharge ends of the individual emitter electrodes by use of the emitter electrodes of the same length and the branches of the same length. In this instance, all of the emitter electrodes have their respective discharge ends spaced by an equal distance from the opposed electrode to generate a uniform amount of the mist from the plural emitter electrodes in a stable manner.

Also, the electrode assembly is preferably made from the same material into a unitary structure in which the emitter electrodes are symmetrically disposed around the stem.

Further, the electrode assembly is preferably connected to receive the high voltage from the high voltage source at a point of connection offset from the branches towards the refrigerator. Thus, it is made possible to apply the high voltage to each of the emitter electrode while keeping the cooling temperature constant at the discharge end of each emitter electrode, assuring to generate the mist in a stable manner.

In order to effectively cool the discharge end of the emitter electrode, the electrode assembly is preferably flitted with a heat insulation sheath which covers a portion extending from the branches to the refrigerator.

Further, it is equally possible to provide a plurality of the opposed electrodes in correspondence to the emitter electrode. In this instance, each of the opposed electrodes is spaced by the same distance to each associated one of the emitter electrodes so as to give the same electric field strength to the discharge end of each emitter electrode, assuring to generate a large amount of the mist in a stable manner.

DETAILED DESCRIPTION OF EXEMPLARY EMBODIMENTS

1st Embodiment

Figure 1:
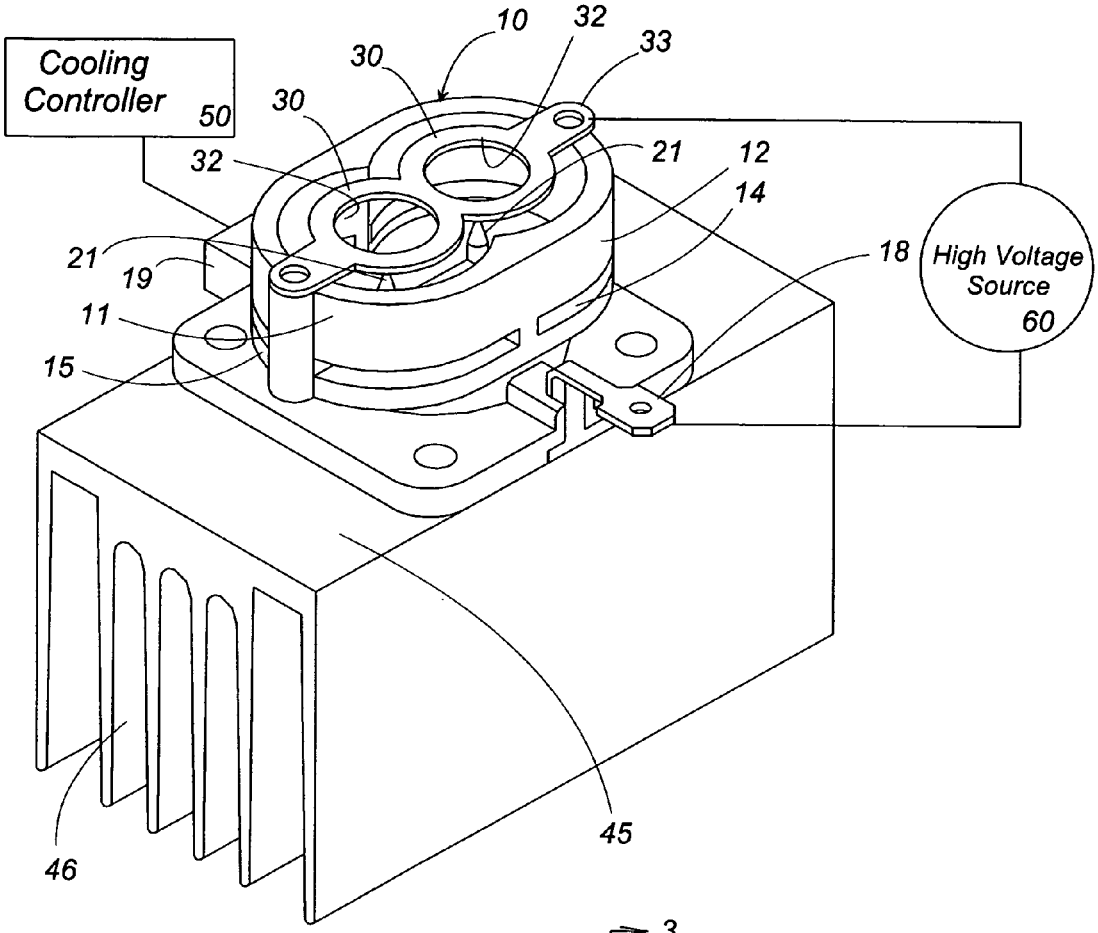
FIG. 1 is a perspective view of an electrostatically atomizing device in accordance with a first embodiment of the present invention.

An electrostatically atomizing device in accordance with the first embodiment of the present invention is explained with reference to the attached drawings. As shown in FIGS. 1 to 4, the electrostatically atomizing device includes a casing 10 in which a plurality of emitter electrodes 21 are disposed. Attached to the top opening of the casing 10 is an electrode plate integrating a plurality of opposed electrodes 30 which are opposed respectively to the ends of the emitter electrodes 21 by a predetermined distance. The electrode plate is formed with a plurality of circular openings 32 each having a center axis on which the tip of each corresponding emitter electrode 21 is disposed.

The emitter electrode 21 is coupled to a refrigerator 40 which cools and condenses the water contained in the ambient air on the emitter electrode 21. The emitter electrode 21 and the opposed electrode 30 are connected to a high voltage source 60. The high voltage source is provided to apply a predetermined high voltage across the emitter electrodes 21 and the opposed electrodes 30 to give a negative voltage (for example −4.6 kV) to the emitter electrodes 21, so as to develop a high voltage electric field between a discharge end 22 at the end of each emitter electrode 21 and the inner periphery of the circular window 32 of each opposed electrode 30, thereby electrostatically charging the water on each emitter electrode 21 for discharging the charged minute water particles in the form of a mist from the discharge end 22. In this connection, the Rayleigh disintegration of the water is induced at the discharge end 22 to generate the mist of charged minute water particles of a size in the order of nanometers, which is discharged outwardly through the circular windows 32 of the opposed electrodes 30.

The refrigerator 40 is realized by a Peltier-effect thermoelectric module (hereinafter referred to as Peltier module) which has a cooling side coupled to the ends of the emitter electrodes 21 opposite to the discharge ends 22 so as to cool the emitter electrodes 21 to a temperature below a dew point of the water by applying a constant voltage to a thermoelectric element composing the Peltier module. The Peltier module is configured to have a plurality of thermoelectric elements connected in parallel between conductive circuit plates to cool the emitter electrodes 21 at a rate determined by a variable voltage given from a cooling controller 50. One of the conductive circuit plates on the cooling side is coupled to the emitter electrodes 21, while the other circuit plate on the heating side is coupled to a heat radiator 45 with heat radiating fins 46. The Peltier module is provided with a thermister for detection of the cooling temperature of the emitter electrodes 21, and the cooling controller 50 is configured to control the temperature of the Peltier module 40 in order to keep an electrode temperature in correspondence with the environmental temperature and humidity, i.e., the temperature such that a sufficient amount of water can be condensed on the emitter electrodes.

The Peltier module 40 is accommodated within the casing 10 together with the emitter electrodes 21. The casing 10 is composed of an upper casing 11 and a lower casing 15 both made of dielectric material. The upper casing 11 surrounds the upper ends of the emitter electrodes 21, while the lower casing 15 accommodates the Peltier module 40. Disposed between the cooling side and the emitter electrodes 21 is a dielectric plate 44 of high thermal conductivity. The upper casing 15 has its bottom closed by the heat radiator 45.

A plurality of the emitter electrodes 21 are integrated into an electrode component 20 of a unitary structure. The electrode component 20 is made of a material of good electrical conductivity and high thermal conductivity such as copper, aluminum, silver, or an alloy thereof, to have a single stem 24, and a plurality of braches 25 extending horizontally from the upper end of the stem 24 with each of the emitter electrodes 21 upstanding from the end of each branch 25. The stem 24 has a flange 26 coupled to the cooling side of the Peltier module 40. The stem 24 extends through an upper wall 16 of the lower casing 15 and the bottom wall 12 of the upper casing 11, while the branches 25 extend along the top surface of the bottom wall 12. The bottom casing 15 and the upper casing 11 are both made of a dielectric material of good thermal insulation. In this instance, a heat insulation sheath may be provided over the stem 24 extending from the Peltier module 40 to the branches 25 in order to enhance heat insulation between the electrode component 20 and the casing 10.

The lower casing 15 is provided with an electrode terminal 18 for connection of the electrode component 20 to the high voltage side of the high voltage source 60. The electrode terminal 18 has its one end connected to the flange 26 at the lower end of the stem 24 within the lower casing 15, and has its other end extending outwardly of the lower casing 15. The grounded side of the high voltage source 60 is connected to a grounding terminal 33 of the opposed electrodes 30. The lower casing 15 is provided on its side end opposite to the electrode terminal 18 with a connector 19 for electrical connection with the cooling controller 50 controlling the Peltier module.

The upper casing 11 is provide in the lower end of its sidewall with an air inlet 14 which introduces the ambient air around the emitter electrodes 21 so as to condensate the water contained in the introduced air on the emitter electrodes 21, allowing the condensed water to be discharged outwardly of the casing from the ends of the emitter electrodes 21 in the form of a mist of the charged minute water particles.

Figure 2:
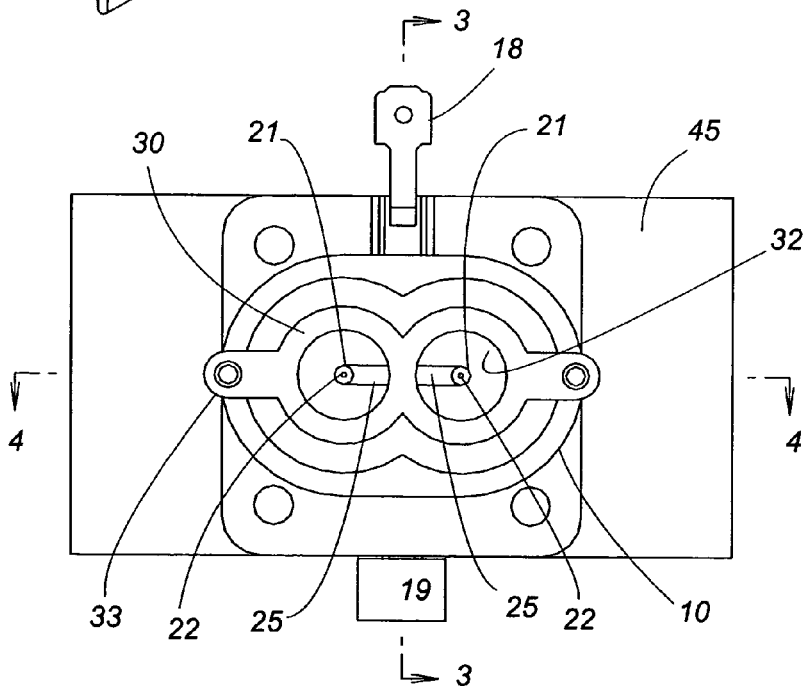
FIG. 2 is a top view of the above device.
Figure 3:
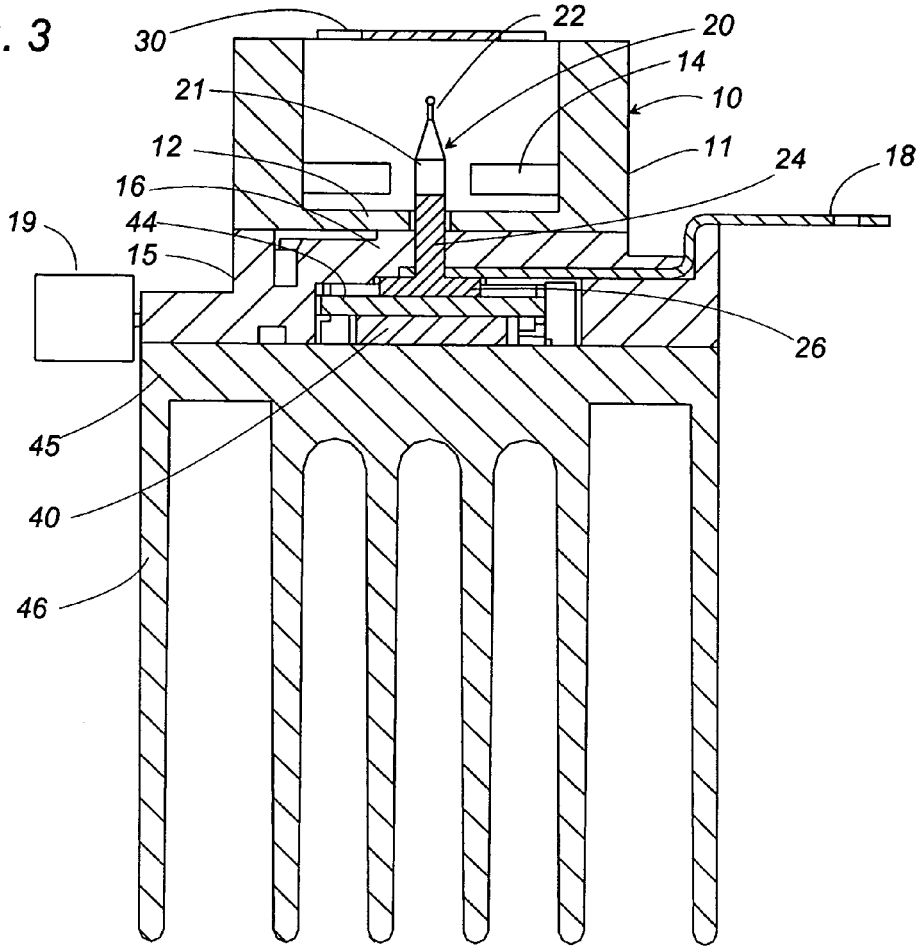
FIG. 3 is a sectional view taken along line 3-3 of FIG. 2.
Figure 4:
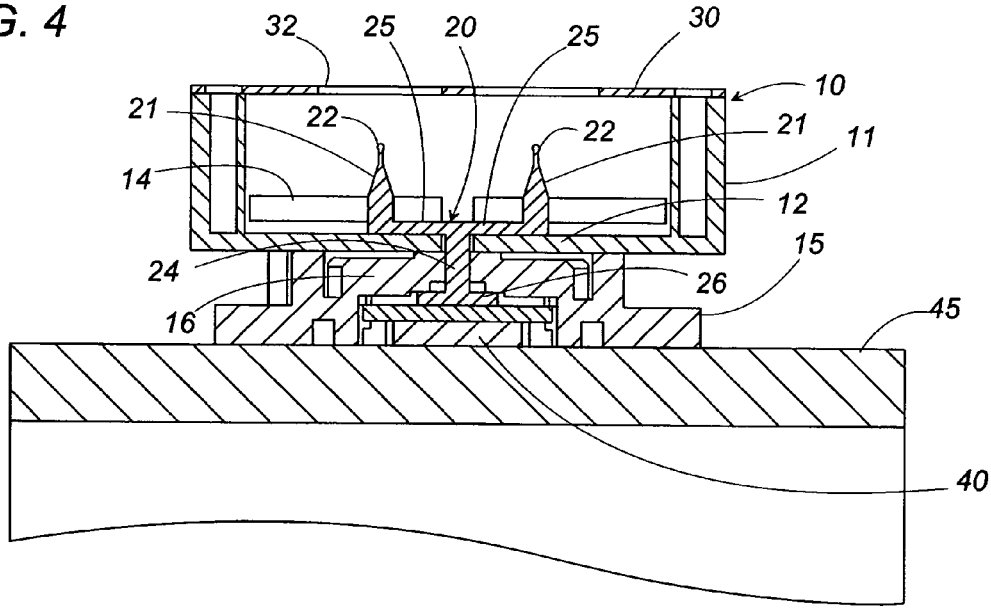
FIG. 4 is a sectional view taken along line 4-4 of FIG. 2.

The emitter electrodes 21 are of identical shape, and are spaced horizontally from the upper end of the stem 24 by the branches 25 of the same length, as shown in FIG. 2, so as to be cooled to the same temperature. The discharge end 22 of each emitter electrode 21 is disposed on a center axis of the circular window 32 of each corresponding opposed electrode 30 to have the same electrical field intensity, enabling to discharge of the mist of the charged minute water particles in an equal amount from each of the emitter electrodes 21.

Figure 5:
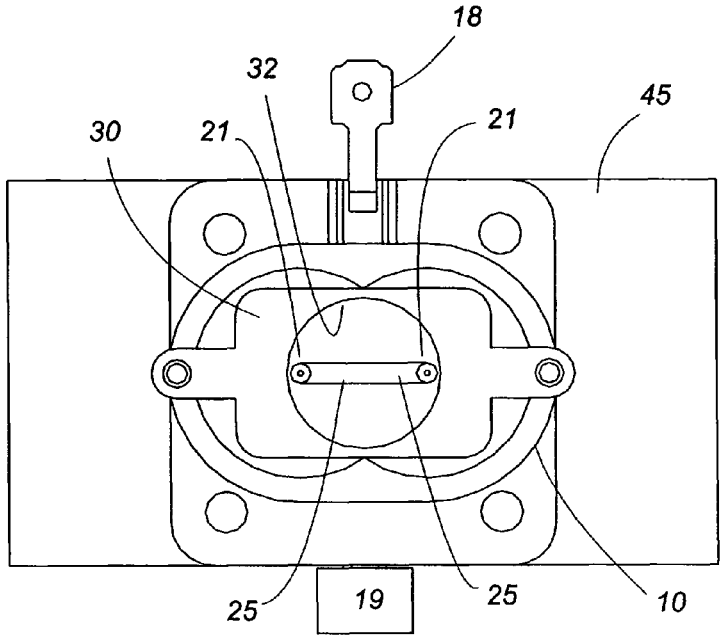
FIG. 5 is a perspective view of a modification of the above device.

FIG. 5 illustrates a modification of the above embodiment in which the opposed electrode 30 used in combination with the two emitter electrodes 21 is formed with a single circular window 32, and the discharge ends are disposed at the diametrically opposed ends of the circular window 32. In this instance, the discharge occurs between the inner periphery of the circular window 32 and each of the discharge ends 22 to generate the mist of the charged minute water particles.

Figure 6:
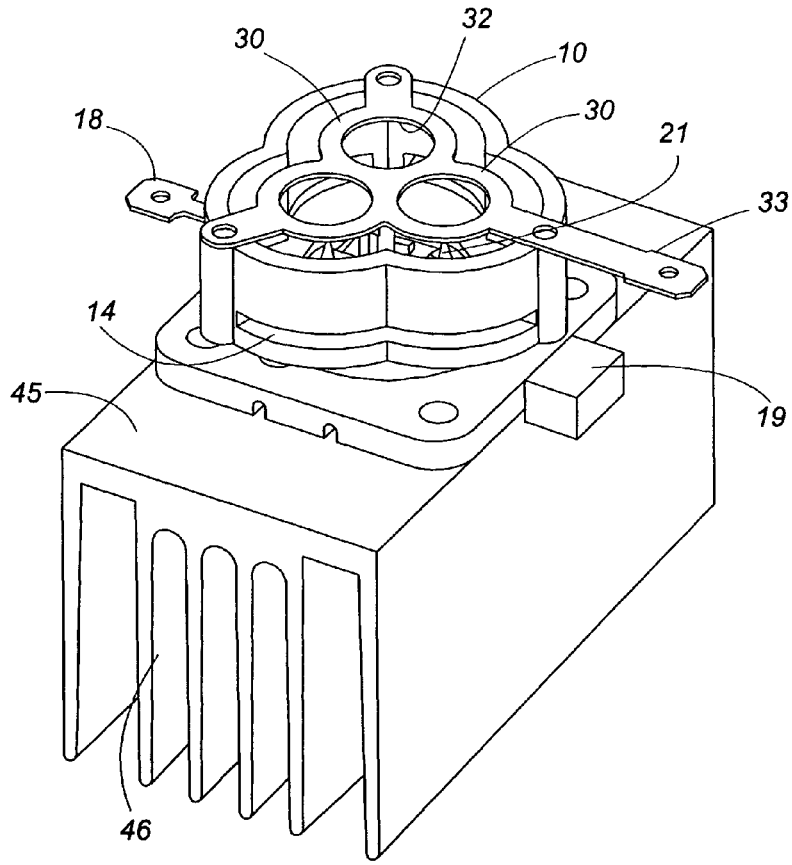
FIG. 6 is a top view of another modification of the above device.

FIG. 6 illustrates another modification in which three emitter electrodes 21 are equiangularly spaced. Also in this instance, the emitter electrodes 21 are integrated into an electrode component of unitary structure, as in the above embodiment, and are coupled to the upper end of the stem 24 by way of the branches 25 of the same length so as to be cooled to the same temperature. The opposed electrode 30 is shaped to have three circular windows 32 each having a center axis on which each emitter electrode is disposed.

Figure 7:
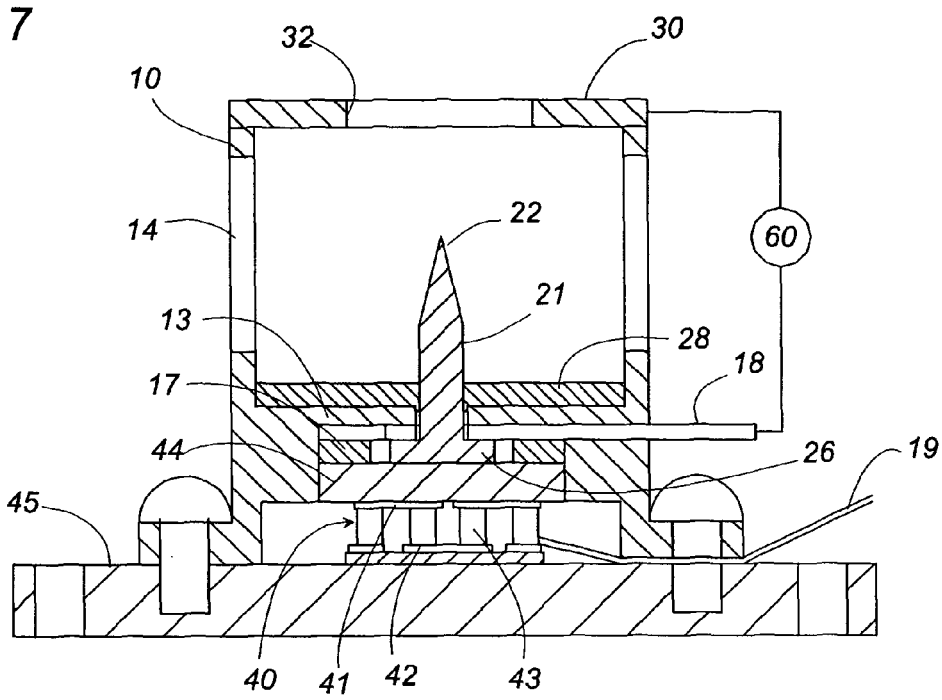
FIG. 7 is a vertical section of a further modification of the above device.

Although the above embodiment and the modifications disclose the device equipped with a plurality of the emitter electrodes, the present invention should not be limited thereto, and is configured to use only the single emitter electrode 21 as shown in FIG. 7. In this modification, the tubular casing 10 is vertically divided by a partition 13 through which the emitter electrode 21 extends. The lower end of the casing 10 is coupled to the heat radiating plate 45, while the Peltier module 40 is accommodated between the partition 13 and the heat radiating plate 45. The Peltier module 40 is configured to have a plurality of thermo-electric elements arranged between a pair of conductive circuit plate 41 and 42, and to have the cooling side circuit plate 41 coupled to the flange 26 at the lower end of the emitter electrode 21 through a dielectric plate of good thermal conductivity. The flange 26 is surrounded by a heat insulation sheath 7 to reduce the heat absorption to the casing. The emitter electrode 21 is connected to the electrode terminal 18 on the lower side of the partition 13, while the Peltier module is connected to the connector 19 projecting outwardly from the lower end of the casing 10. Provided on the upper side of the partition 13 is a water container 28 which absorbs an excessive amount of the water generated at the emitter electrode 21 to prevent the water from leaking to the side of the electrode terminal 18 and the Peltier module 40.

2nd Embodiment

Figure 8:
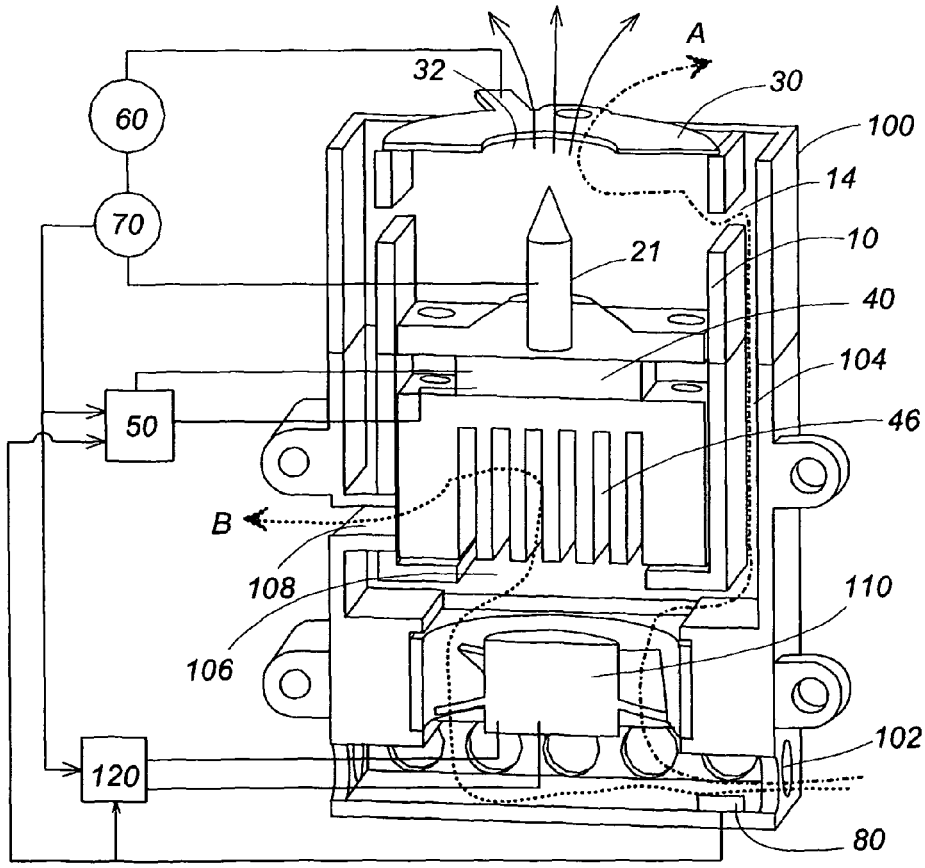
FIG. 8 is a perspective view of an electrostatically atomizing device in accordance with a second embodiment of the present invention with a portion being removed.

FIG. 8 illustrates an electrostatically atomizing device in accordance with second exemplary embodiment of the present invention which is basically identical to the above embodiment except that a fan 110 is accommodated within a single housing 100 together with the casing 10. The casing 10, which carries the emitter electrode 21, the opposed electrode 30, the Peltier module 40, and the heat radiating fins 46, is disposed in the upper end of the housing 100, while the fan 110 is disposed in the lower end of the housing 100. In the present embodiment, the Peltier module is utilized as a heat exchanger defining a refrigerator at its one end, and a heat radiator at the other end. The fan 110 is provided to take in the ambient air through the air inlet 102 and discharge it outwardly through an air intake path 104 and a heat exchange path 106 formed in the housing 106. The air intake path 104 is formed downstream of the fan 110 between the casing 10 and the housing 100 to guide the forced air flow A generated by the fan from through the air inlet 14 into the casing 10, and discharge it outwardly through the circular window 32 of the opposed electrode 30, during which the water content of the air is condensed on the emitter electrode 21 and the mist of the charge minute particles discharged from the emitter electrode 21 is carried on the forced air flow to be expelled outwardly.

While, on the other hand, the heat exchange path 106 is provided to guide a forced air flow B through passes around the heat radiating fins 46 on the downstream side of the fan 110 and to expel it outwardly through discharge port 108 in the wall of the housing 100. Thus, the air flow contacts with the heat radiating fins 46 to improve cooling effect at the Peltier module 40. The heat exchange path 106 is separated from the air intake path 104 to avoid the air heated by the heat radiating fins from leaking towards the emitter electrode 21. With this result, the emitter electrode 21 is supplied with the fresh air to effectively condense the water therefrom.

A temperature-humidity sensor 80 is provided around the air inlet 102 for detection of the environmental temperature and humidity. The cooling controller 50 controls the voltage applied to the Peltier module 40 to cool the emitter electrode 21 to a temperature determined by the environmental temperature and humidity, i.e., to the temperature at which a sufficient amount of water is condensed on the emitter electrode 21. Also, the cooling controller 50 is connected to a current meter 70 for monitoring a discharge current flowing between the emitter electrode 21 and the opposed electrode 30, in order to control the Peltier module for keeping the discharge current constant. As the discharge current is proportional to the amount of the charge minute water particles discharged from the discharge end 22, or the amount of the water condensed on the emitter electrode, it is possible to continuously discharge the mist of the charged minute water particles in a constant amount by controlling the Peltier module 40 to keep the constant discharge current.

The fan 110 is connected to an air flow controller 120 for regulating the amount of the air flow being supplied to the emitter electrode 21 and the heat radiating fins 46. The air flow controller 120 is connected to the current meter 70 and the temperature-humidity sensor 80 to regulate the amount of the air flow depending upon the discharge current and the environmental temperature and humidity. For example, when there is a great difference between the environmental temperature and the emitter electrode, the amount of the air flow is increased in order to enhance the cooling efficiency at the Peltier module. Also, when there is a shortage of the condensed amount of the water on the emitter electrode, the amount of air flow is increased to supply a more amount of the ambient air to the emitter electrode. On the other hand, when a sufficient amount of water is being condensed on the emitter electrode, the fan is stopped or the amount of the air flow is lowered to keep discharging the mist of the charged minute water particles in a constant amount.

A freezing of the water condensed on the emitter electrode 21 may occur when the emitter electrode 21 is over-cooled in a particular environment. Upon occurrence of the freezing, the discharge current is reduced and this condition can be acknowledged by the cooling controller 50. In such case, the cooling controller 50 controls the Peltier module 40 to raise the temperature of the emitter electrode 21 to remove the freezing. For example, the cooling by the Peltier module is lowered or stopped. Further, the polarity of the voltage applied to the Peltier module may be temporarily reversed to heat the emitter electrode 21. Under this circumstance, the cooling controller 50 can be configured to switch the functions of freezing the water content in the air and melding the frozen water in order to supply a suitable amount of water to the emitter electrode 21.

Figure 9:
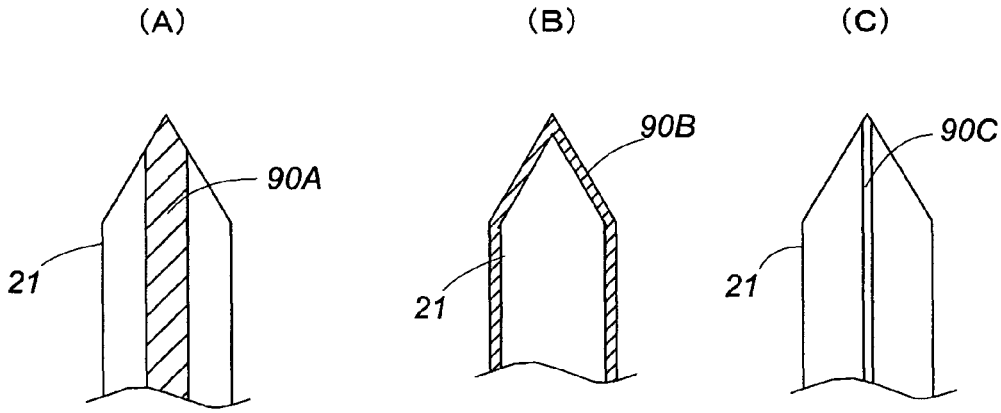
FIGS. 9(A), 9(B), and 9(C) are explanatory views respectively illustrate the emitter electrodes of various shapes available in the present invention.

As shown in FIG. 9, the emitter electrode 21 may be formed with a water container temporarily holding an excessive amount of water. FIG. 9(A) illustrates an example in which the emitter electrode 21 is formed in its center with the water container 90A made of a porous ceramic to exhibit a capillary action. In FIG. 9(B), an example is illustrated in which the emitter electrode 21 is formed in its outer surface with capillary grooves extending in the axial direction to define the water container 90B. In either example, the water container is hydrophilically treated, while the other portion is hydrophobically finished, for example, by coating with a water-repellant layer. In FIG. 9(C), the emitter electrode 21 is formed internally with a capillary gap extending in the axial direction to define the water container 90C. For example, the gap may be formed in the interior of the emitter electrode by dividing the emitter electrode into two-halves or three-pieces.

Figure 10:
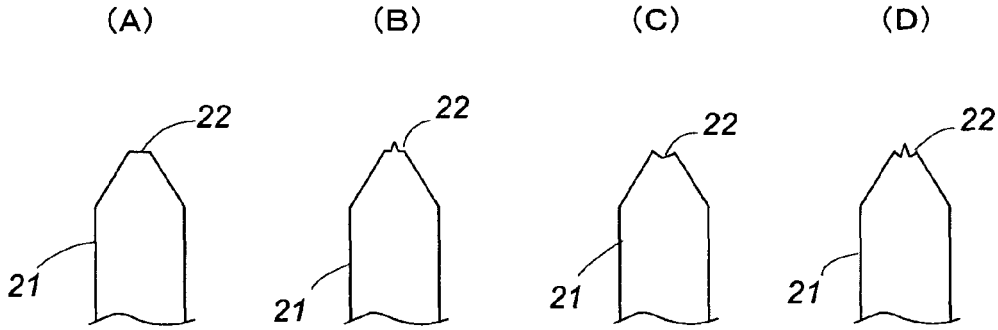
FIGS. 10(A), 10(B), 10(C) and 10(D) are explanatory views respectively illustrate the emitter electrodes of various shapes available in the present invention.

FIG. 10 illustrates various structures of giving increased water holding capacity to the discharge end 22 of at the distal end of the emitter electrode 21. FIG. 10(A) illustrates an example in which the discharge end 22 is formed with a flat face to hold the water thereon by the surface tension of the water. FIG. 10(B) illustrates an example in which a sharp projection is formed centrally on the flat face to concentrate the electric charge thereto. In FIG. 10(C), an example is illustrated in which the discharge end is formed with a concave to hold the water therein. In FIG. 10(D), an example is illustrated in which a sharp projection is formed centrally on the concave. In either example, the water supplied to the discharge end can be suitable held thereat, enabling the water to successfully induce the Rayleigh disintegration of the water and therefore assuring to give the electrostatic atomization in a stably matter. More than one projection may be formed to increase the amount of the mist.

The invention claimed is:

1. An electrostatically atomizing device comprising:

an emitter electrode;

an opposed electrode opposed to said emitter electrode;

a water feeder configured to give water on said emitter electrode, a high voltage source configured to apply a high voltage across said emitter electrode and said opposed electrode to electrostatically charge the water on said emitter electrode for spraying charged minute water particles from a discharge end of said emitter electrode, wherein said water feeder is configured to cool the emitter electrode so as to condense the water on said emitter electrode from within the surrounding air.

2. The device as set forth in claim 1, wherein said water feeder comprises a refrigerator.

3. The device as set forth in claim 1, wherein said water feeder has a freezing function of freezing water content of the surrounding air on said emitter electrode, and a melting function of melting the frozen water on said emitter electrode.

4. The device as set forth in claim 2, further including a fan which is configured to introduce the surrounding air around said emitter electrode through an air intake path.

5. The device as set forth in claim 4, wherein said refrigerator is combined with a heat radiator to define a heat exchanger, said heat exchanger being accommodated within a housing together with said emitter electrode, said housing being formed with a heat exchange path which is separated from said air intake path to introduce the surrounding air to said heat radiator and drive it out of said housing.

6. The device as set forth in claim 1, wherein said emitter electrode is integrally formed with a water container extending along its length which holds a volume of the water.

7. The device as set forth in claim 2, wherein said refrigerator is realized by a Peltier-effect thermoelectric module having a cooling side and a heater side, said cooling side being coupled to said emitter electrode for cooling the same.

8. The device as set forth in claim 2, wherein a plurality of said emitter electrodes are disposed, said emitter electrodes being thermally coupled to said refrigerator to have the respective discharge ends cooled to the same temperature, said emitter electrodes being electrically coupled to said high voltage source to have the respective discharge ends receiving the same electric field strength.

9. The device as set forth in claim 8, wherein the plurality of said emitter electrodes are integrated into an electrode assembly having a single stem coupled to said refrigerator, said emitter electrodes extending from said single stem respectively by way of branches.

10. The device as set forth in claim 8, wherein all of said emitter electrodes have their respective discharge ends spaced by an equal distance from said opposed electrode.

11. The device as set forth in claim 9, wherein said electrode assembly is made from the same material into a unitary structure, said emitter electrodes being symmetrically disposed around said stem.

12. The device as set forth in claim 11, wherein said electrode assembly is connected to receive the high voltage from said high voltage source at a point of connection offset from said branches towards said refrigerator.

13. The device as set forth in claim 9, wherein said electrode assembly is fitted with a heat insulation sheath covering a portion extending from said branches to said refrigerator.

14. The device as set forth in claim 8, wherein a plurality of said opposed electrodes disposed respectively in relation to said emitter electrodes, each of said opposed electrodes being spaced by the same distance to each associated one of said emitter electrodes.

* * * * *